US005487488A

United States Patent [19]

Cho

[11] Patent Number: 5,487,488

[45] Date of Patent: Jan. 30, 1996

[54] VENDING MACHINE

[75] Inventor: Wan J. Cho, Busan, Rep. of Korea

[73] Assignee: LG Industrial Systems Co., Ltd., Seoul, Rep. of Korea

[21] Appl. No.: 252,357

[22] Filed: Jun. 1, 1994

[30] Foreign Application Priority Data

Jun. 2, 1993 [KR] Rep. of Korea ..... 9522/1993 U
Jun. 29, 1993 [KR] Rep. of Korea ..... 11663/1993 U

[51] Int. Cl.[6] ..... B65D 83/00
[52] U.S. Cl. ..... 221/150 HC
[58] Field of Search ..... 221/150 HC, 150 R, 221/150 A, 154

[56] References Cited

U.S. PATENT DOCUMENTS 3,620,341 11/1971 Gardner ..... 221/150 HC X
3,653,541 4/1972 Crum ..... 221/150 HC
3,866,795 2/1975 Urano ..... 221/150 HC

FOREIGN PATENT DOCUMENTS 2593308 5/1987 France ..... 221/150 HC X
3-104287 5/1991 Japan .
3163691 7/1991 Japan ..... 221/150 HC X
4373094 12/1992 Japan ..... 221/150 HC X
WO8607648 12/1986 WIPO ..... 221/150 A X

*Primary Examiner*—William E. Terrell
*Assistant Examiner*—Dean A. Reichard
*Attorney, Agent, or Firm*—Oliff & Berridge

[57] ABSTRACT

A vending machine having a food storage box, a food freezing chamber having a chute provided for permitting the food from the food storage box to fall down, a food heating apparatus for heating the food fallen from the chute and a food heating chamber having a food discharging port for discharging the heated food, includes a movable type cooled air discharging prevention device, provided between a food discharging opening provided at a lower portion of the chute and an upper shutter provided at an upper portion of the food heating apparatus, for preventing the cooled air from being discharged outside; and a stationary type supporting device, provided between a lower plate of the food freezing chamber and the movable type cooled air discharging prevention device, for permitting the movable type cooled air discharging prevention device to smoothly move and bumpering the impact thereonto.

21 Claims, 7 Drawing Sheets

VENDING MACHINE

BACKGROUND OF THE INVENTION

1. Field of the Invention

The present invention relates to a vending machine capable of preventing a heat loss therein and dew created by a temperature difference between a food freezing chamber and a food heating chamber.

2. Description of the Prior Art

Referring to FIGS. 1 to 3, as known from Japan Pat. No. 3-104287, there are shown a cabinet 10, a food freezing chamber 20 for freezing and storing foods therein, a food heating apparatus 40 for heating foods from the food freezing chamber 20, and a food heating chamber 30 including a food discharging port 70 for discharging heated foods provided below the food heating apparatus 40.

The food freezing chamber 20 provided at an upper portion inside the cabinet 10 usually keeps the temperature of −18° C.—20° C. A plurality of food storage boxes 21 is provided in an upper portion of the cabinet 10. A chute 22 is provided at a lower portion of the food storage boxes 21. In an operation, the selected foods come down to the food heating apparatus provided under the chute 22.

The food in the food heating apparatus 40 is heated to a desired temperature by a magnetron heating device(not described in the drawing) provided therein. As shown in FIG. 2 and FIG. 3, when the food falls down from the food freezing chamber 20, the upper shutter 41 opens due to a horizontal movement of a lower opening 8 of the food heating apparatus 40. When the food is loaded therein the upper shutter 4 is closed. The loaded food is heated for 1 minute by the magnetron heating apparatus. When the heating is completed, the lower shutter 42 opens due to a slidable movement of the lower shutter 42, so that the food is discharged via a food discharging port 70.

However, the conventional vending machine as shown in FIG. 3 has some problems in that the cooled air is discharged to the outside since the lower opening 8 of the shutter 22 is spaced from the upper shutter 41. In addition, the upper shutter 41 for only performing the slidable opening operation is provided on the upper portion of the food heating apparatus 40. In this case the slidable opening operation of the upper shutter 41 means when the food falls down from the food freezing chamber 20, it opens and when heating the fallen food, it closes. After heating the food in the food heating apparatus 40, the heat in the food heating apparatus 40 is transferred to the food freezing chamber 20 so that the heat loss takes place in the vending machine and thus the food in the food freezing chamber is melted and becomes rotten due to the increasing temperature therein.

SUMMARY OF THE INVENTION

Accordingly, it is an object of the present invention to provide a vending machine capable of preventing a cooled air discharging outside and heat, generated at a food heating apparatus, to transfer to a food freezing chamber.

It is a further object of the present invention to prevent dew generating due to a temperature difference between a food freezing chamber and a food heating chamber.

To achieve the object, the present invention includes a movable type cooled air discharging prevention means, provided between a food discharging opening provided at a lower portion of the chute and an upper shutter provided at an upper portion of the food heating apparatus, for preventing the cooled air from being discharged outside; and a stationary type supporting means, provided between a lower plate of the food freezing chamber and the movable type cooled air discharging prevention means, for permitting the movable type cooled air discharging prevention means smoothly to move and bumpering the impact thereonto.

DESCRIPTION OF THE PREFERRED EMBODIMENTS

Figure 1:
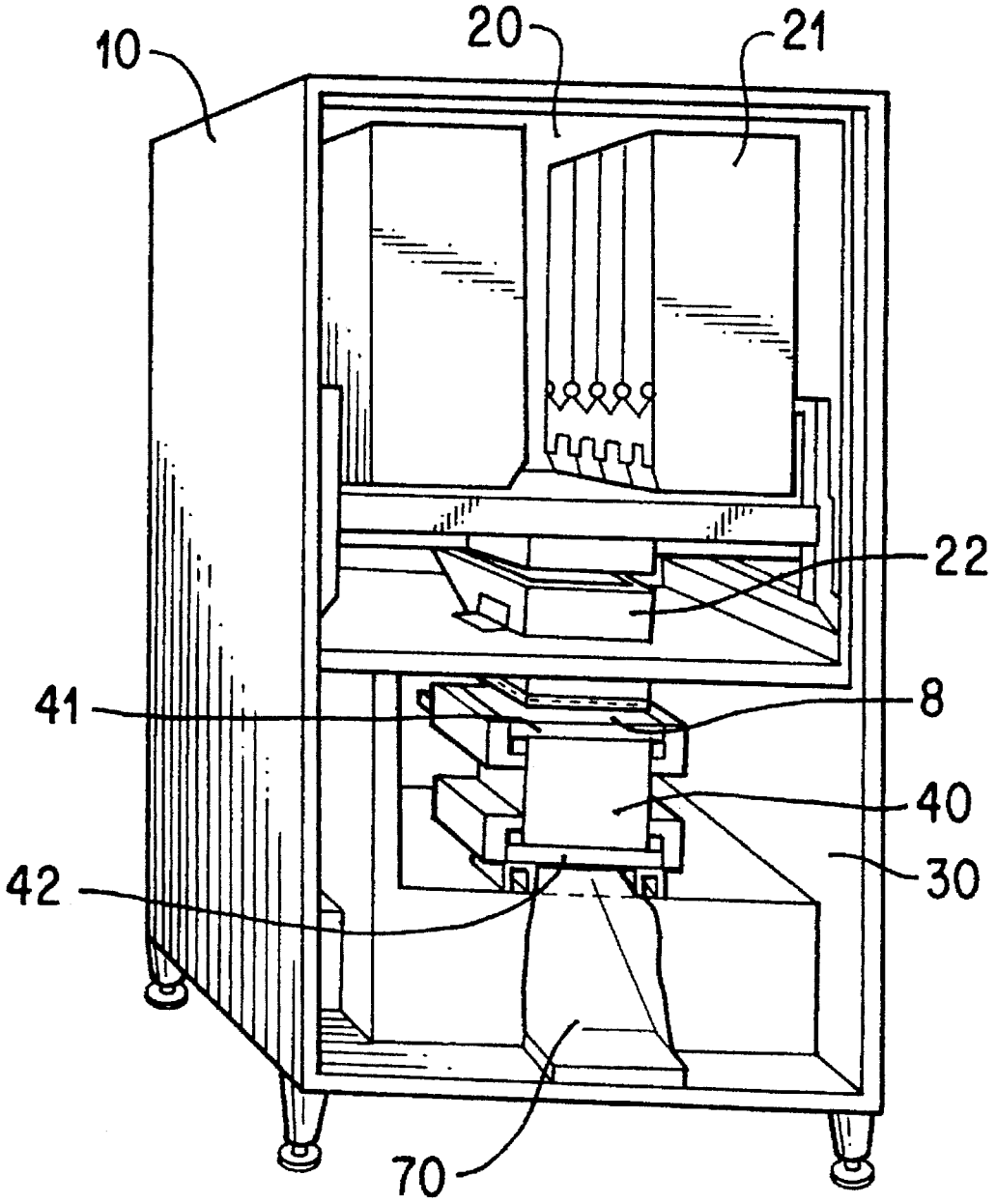
FIG. 1 CONVENTIONAL ART
FIG. 1 is a schematic perspective view showing a conventional vending machine with a removed front door thereof.
Figure 2:
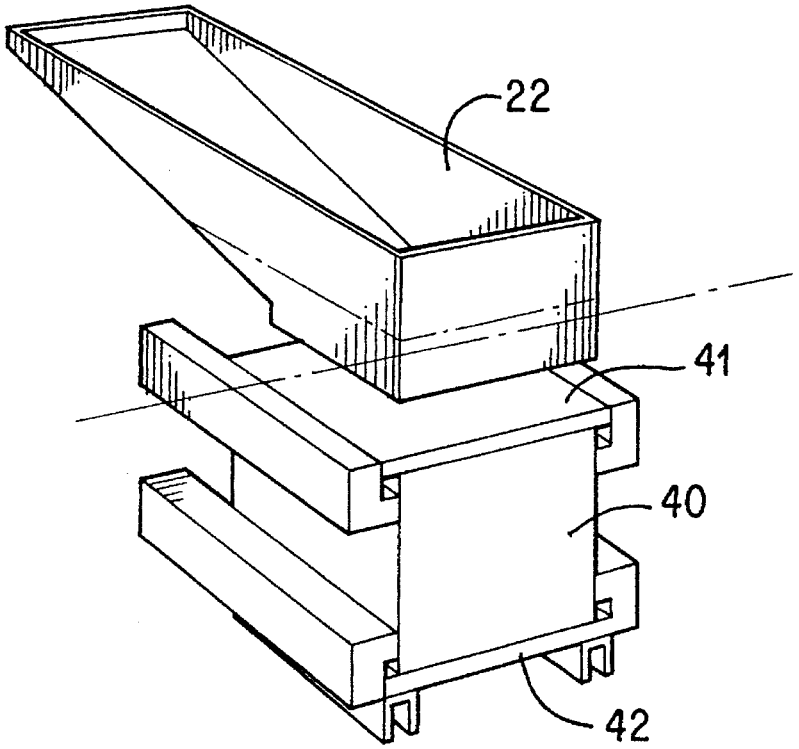
FIG. 2 CONVENTIONAL ART
FIG. 2 is a perspective view showing a relationship between a conventional vending machine and shutter.
Figure 3:
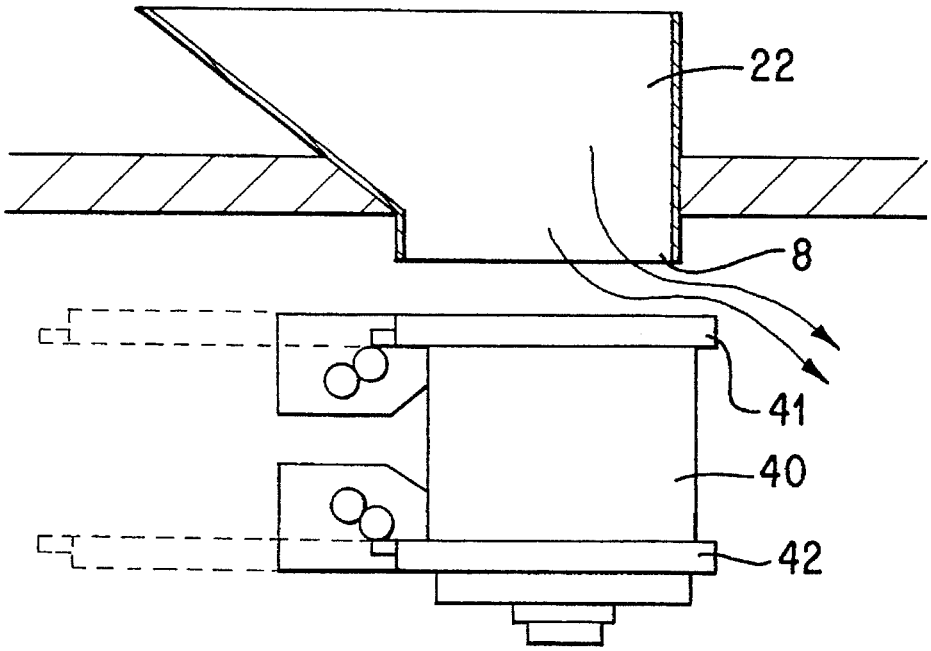
FIG. 3 CONVENTIONAL ART
FIG. 3 is a cross sectional view showing an operational state of upper shutter and lower shutter of a food heating apparatus according to the conventional vending machine.
Figure 4:
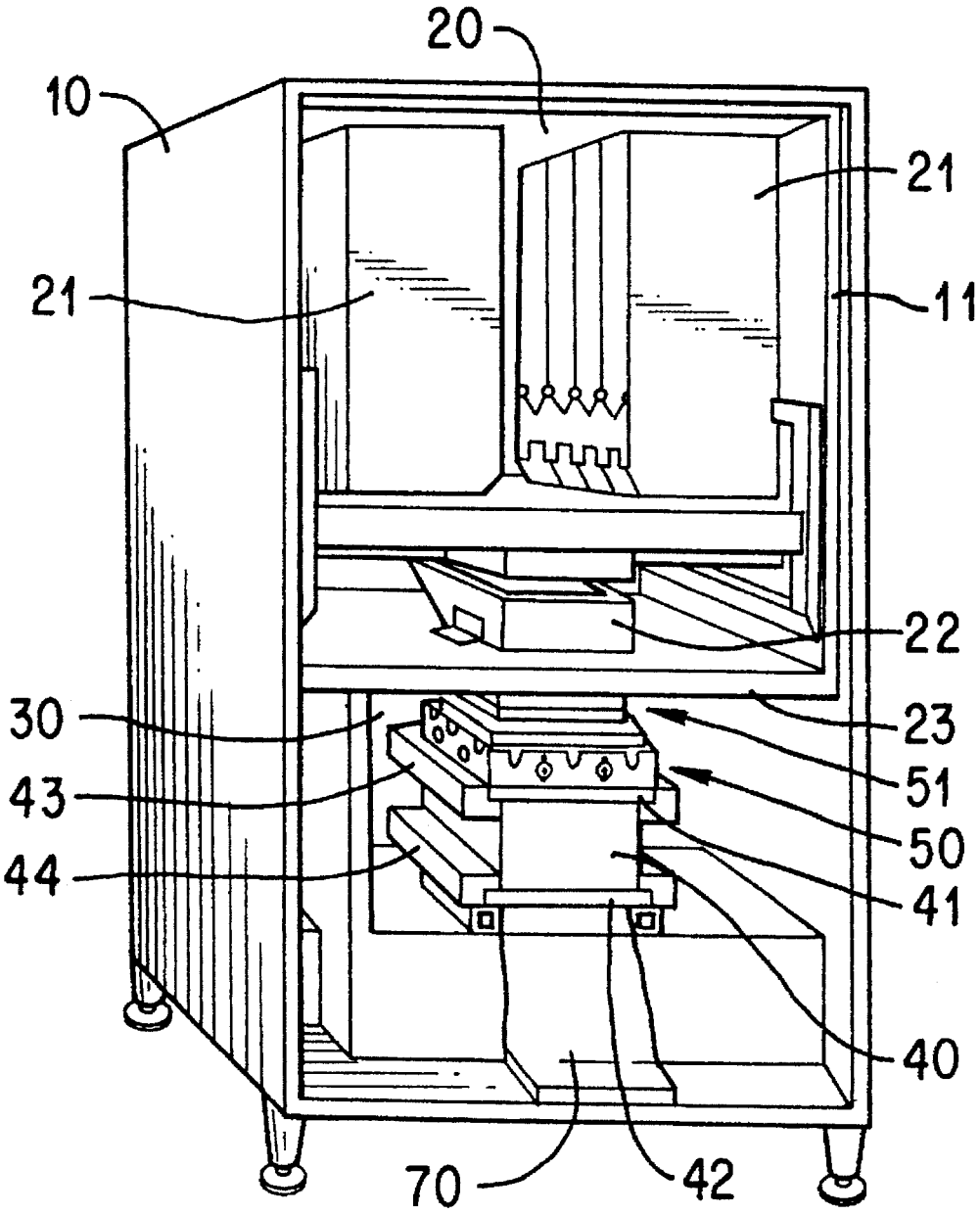
FIG. 4 is a schematic perspective view showing a vending machine with a removed front door thereof according to the present invention.

Referring to FIG. 4, there are shown a cabinet 10 of a vending machine, a food freezing chamber 20 with an insulating wall 11 wrapping therearound provided at an upper inner portion of the cabinet 10, and a food heating chamber 30, provided at a lower portion of the food freezing chamber 20, having a food heating apparatus 40 for receiving the food discharged from the food freezing chamber 20 and heating the food, and a food discharging port 70 for discharging the heated food.

In both inner sides of the food freezing chamber 20 are provided a plurality of food storage boxes 21 spaced apart from each other by a predetermined space. At a lower portion the food storage boxes 21 are provided with a chute 22 for guiding the selected food to drop down in a direction of the food heating apparatus 40.

Figure 7:
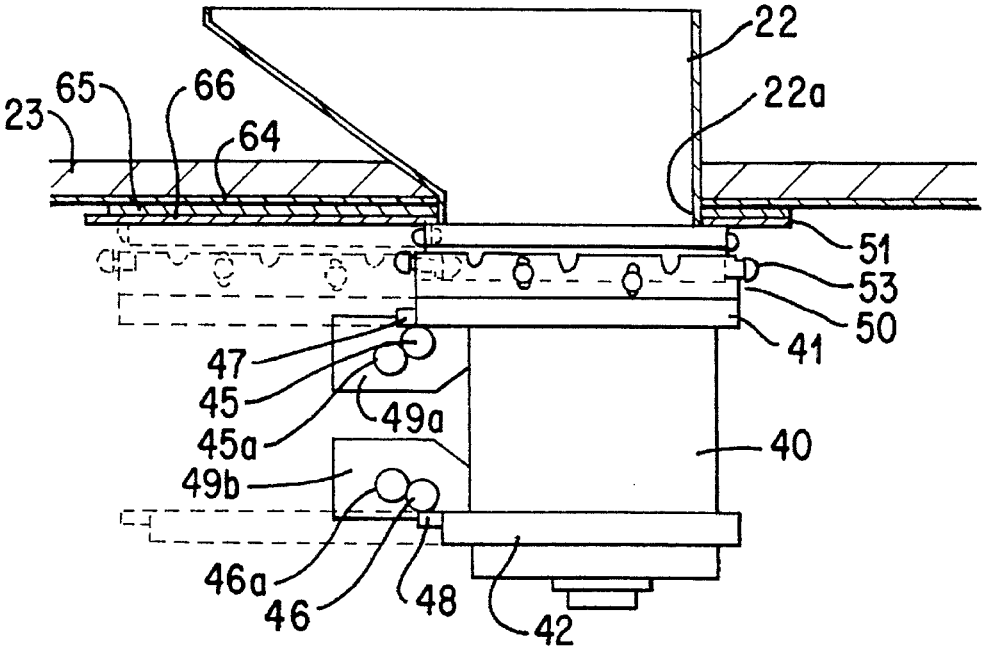
FIG. 7 is a partial cross sectional view showing an opening and closing operation of upper and lower shutters of an embodiment according to the present invention.

The food heating apparatus 40 provided at a center portion of the food heating chamber 30 is formed in a box shape whose inside is opened as shown FIG. 4 or FIG. 7. Both upper and lower openings (not shown in FIGS.) of the food heating apparatus 40 are opened/closed by the upper and lower shutter 41 and 42 slidably opened and closed.

The upper and lower shutter 41 and 42 are slidably provided with a first and second guiding rail 43 and 44 connected to an end of the cabinet 10 (refer to FIG. 4). A plurality of reversingly rotating pinions 45 and 46 by the driving motor(not shown in FIG.) and a plurality of rack gears 47 and 48 engaged with the pinions 45 and 46 are provided at a rear portion of the food heating apparatus 40. The pinions 45 and 46 are engaged to the brackets 49*a* and 49*b* fixedly attached to the guiding rails 43 and 44.

Figure 6:
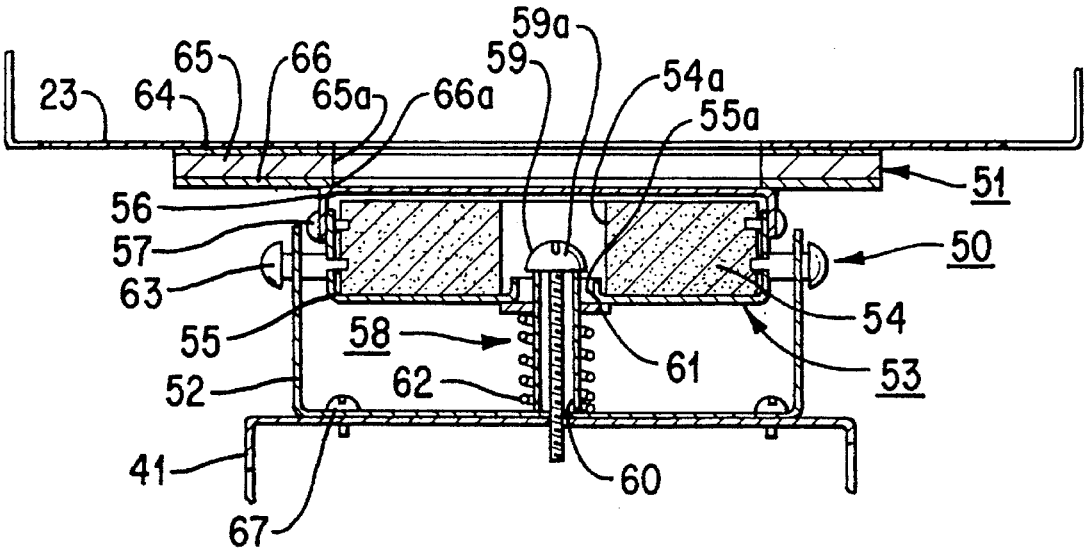
FIG. 6 is a cross sectional front view showing a combination of an embodiment according to the present invention.

In a state that the upper shutter 41 is closing the upper opening of the food heating apparatus 40, as shown in FIGS. 6 and 7, for preventing the cooled air in the food freezing chamber 20 from flowing outside by closing the lower opening of the chute 22, there is provided a movable type cooled air discharging prevention means 50. For causing the movable type cooled air discharging prevention means 50 to move smoothly and absorb impacts effectively, there is provided a stationary guide supporting means 51 at a lower plate 23 of the food freezing chamber 20.

Figure 5:
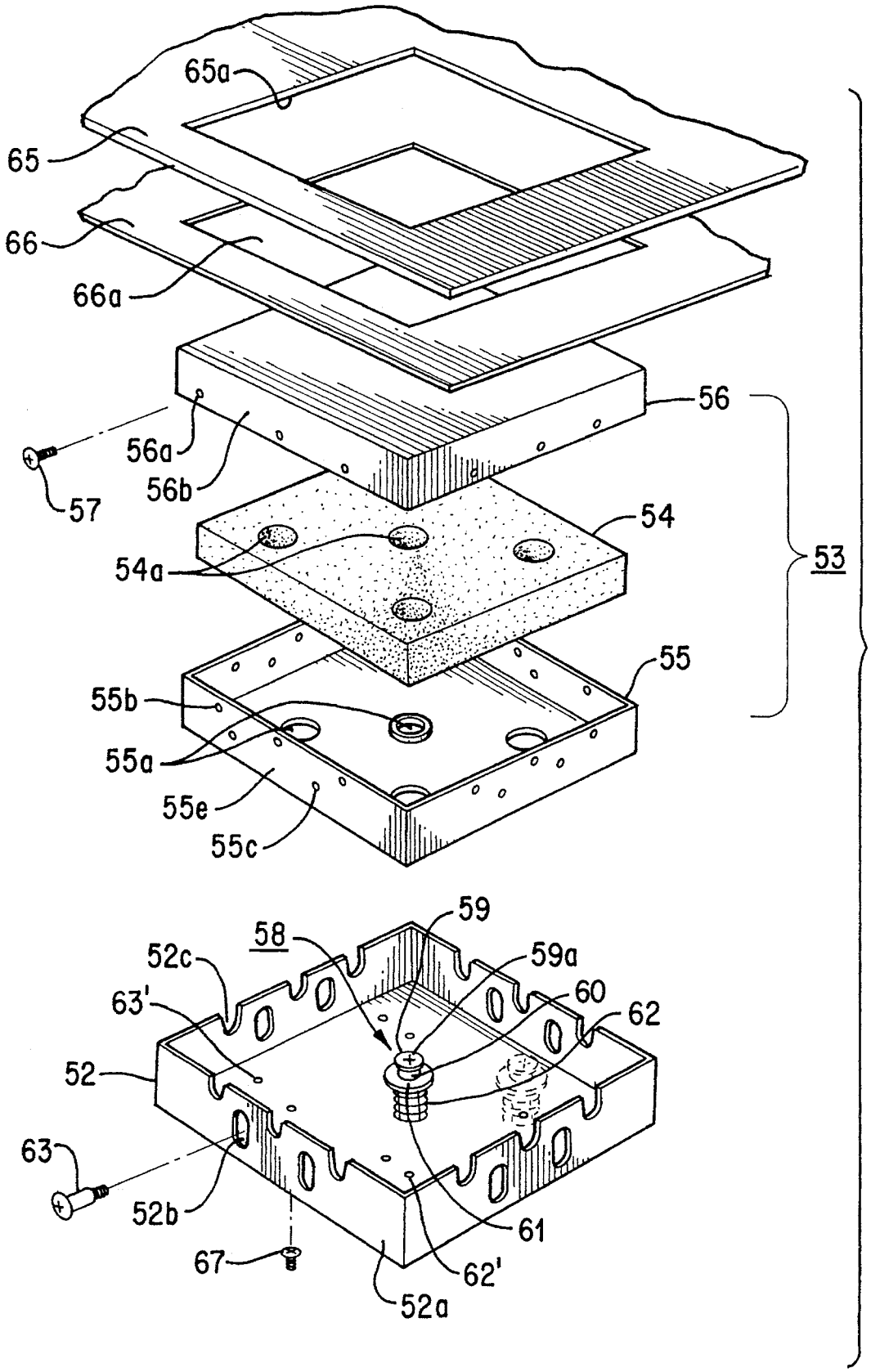
FIG. 5 is a perspective view showing a disassembled movable type cooled air discharging prevention means and stationary type guide support means of an embodiment according to the present invention.

The movable type cooled air discharging prevention means 50, as shown in FIGS. 5 and 6, includes an upper portion-opened and box-shaped fixing housing 52 fixedly provided by a screw at an upper portion of the shutter 41, an insulating panel assembly 53 fitted into the fixing housing 52 and engaged therewith, and an elastic supporting means 58 provided for ensuring the sealing between the insulating panel assembly and the chute 22 of the food freezing chamber 20 by providing a plurality thereof at the bottom portion of the fixing housing 52.

The insulating panel assembly 53 includes a longitudinally-shaped insulating plate 54 having a plurality screw openings 54*a* provided at a predetermined position, a plurality of screw openings 55*a* matching with the screw openings 54*a* of the insulating plate 54, a lower housing 55 fitted with the insulating plate 54, and an upper housing 56 fitted to the lower housing 55 in which the insulating plate 54 is fitted.

On each of side wall 55*e* of the lower housing 55 are provided three screw holes 55*b* and two screw holes 55*c* with a predetermined space at a bottom portion of the screw openings 55*b*. On a side wall of the upper housing 56 are provided a plurality of screw holes 56*a* at a predetermined portion thereof.

When engaging the lower housing 55 and upper housing 56, after permitting the insulating plate 54 be engaged into the lower housing 55, and a plurality of screw holes 56*a* provided at each of side wall 56*b* of the upper housing 56 be fitted into a plurality of screw holes 55*b* provided at each of a side wall of the lower housing 55, thus assembling the upper housing 56 and the lower housing 55 to each other by the screw 57 for an insulating panel assembly 53.

In addition, the insulating panel assembly 53 is provided at a central position of the fixing housing 52 in order to enhance the sealing properties and is supported with a plurality of elastic supporting means 58. The four elastic supporting means 58 are preferably provided at a predetermined bottomed portion of the fixing housing 52 and one elastic supporting means is provided at a central position. However, the further number of elastic supporting member 58 can be considered for requirements of users. In this embodiment, only one elastic supporting means 58 is provided.

The elastic supporting means 58 is inserted with a supporting body 60 at a bottomed portion of the fixing housing 52 in a manner of being in contact with a bottomed portion of the fixing housing 52 by inserting an elastic member 62 into the supporting body 60. A washer 61 is provided at an upper portion of the elastic member 62. The upper portion of the supporting body 60 is engaged with the screw 59.

The elastic member 62 is preferred to be a compression coil spring. Other elastic members can be used for elastic supporting means in case that it elastically supports the insulating panel assembly 53.

Meanwhile, a screw head 59*a* of the screw 59 is provided to support a predetermined portion of the upper housing 56 via a screw opening 55*a* of the lower housing 55 and a screw opening 54*a* of the insulating plate 54. In addition, on every side of side wall 52*a* of the fixing housing 52 are provided a plurality of screw openings 52*b* spaced apart by a predetermined distance therebetween. On one end of upper portion of side wall 52*a* are provided a plurality of semicircular screw openings 52*c* spaced apart by a predetermined distance there between. As a plurality of screws 63 is inserted into the screw opening 52*b* provided at the wall side 52*a* of the fixing housing 52, the fixing housing 52 is engaged with the insulating panel assembly 53, so that the insulating panel assembly 53 goes up by a diameter of a long side of the screw opening 52*b* of the fixing housing 52.

As shown in FIGS. 5 and 6, the stationary type guide supporting means 51 includes an elastic plate 65 adhesively fixed with an adhesive 64 at a lower portion of the lower plate 23 of the food freezing chamber 20, and a film 66 slidable being in contact with the upper plate 56 during a movement of an insulating panel assembly 53 fixedly provided at the bottom portion of the elastic plate 65. And, there are provided screw holes 65*a* and 66*a* coinciding with the food discharging port 22*a* provided at a lower portion of the chute 22.

It is preferred to use two face adhesive. The film 66, when the insulating panel assembly 53 slides, should be made of such as PE(Polyester) in order to minimize a friction force.

The description of the operational relationships will be provided hereinafter.

First, the initial state of the vending machine according to the present invention means that the upper shutter 41 for closing/opening the upper opening of the food heating apparatus 40 and the lower shutter 42 for opening/closing the lower opening are completely closed. It shows a full line in FIG. 7.

When the user starts the operation of the vending machine, the desired food being in the food storage box 21 of the food freezing chamber 20 falls down via the chute 22. At the same time, the motor (not shown in the figures) operates. The pinions rotates upon the rotation of the motor. The upper shutter 41 slidably moves in a direction of a portion shown in a virtual line upon an operation of the pinion 45 and the rack 47 since the pinion 45 is engaged with rack 47 fixed to the upper shutter 41. The upper opening of the food heating apparatus 40 opens and the food is inputted into the food heating apparatus 40.

When the input of the food into the food heating apparatus 40 is finished, the upper shutter 41 is closed in a reverse operation of the pinion 45 and the rack 47. The magnetron heating apparatus (not shown in figures) provided at the food heating apparatus operates and the inputted food is heated.

At this time, the food is heated for about one minute. When the heating process is finished, the pinion 46 rotates upon the motor. The lower shutter 42 slidably moves in a direction of portion shown in a virtual line in FIG.7. The lower opening of the food heating apparatus 40 opens. The heated food is discharged to the food discharging port 70. The user can get the desired food.

When the output operation is finished like that, the lower shutter 42 permits the lower opening of the food heating apparatus 40 be closed by a reverse operation of the pinion 46 and the rack 48.

In an operation of selling food in the vending machine, the food discharging opening 22*a* of the chute 22 of the food freezing chamber 20 is opened/closed by the movable type cooled air discharging prevention means 50 provided at the upper portion of the upper shutter 41 thus preventing the cooled air in the food freezing chamber 20 from being discharged outside. In an initial operational state, the food discharging opening 22*a* of the chute 22 of the food freezing chamber 20, as shown in the full line in FIG. 7, is opened/closed by the insulating panel assembly 53 of the movable type cooled air discharging prevention means 50 so that the cooled air in the freezing chamber 20 cannot be discharged outside.

In addition, after the food is inputted into the food freezing chamber 20 the heated air generated in the food heating apparatus 40 is cut to flow up toward the food freezing chamber 20 since the food discharging opening 22*a* is closed by the movable type cooled air discharging prevention means 50 during the operation of the magnetron heating apparatus in the food heating apparatus 40.

Meanwhile, as shown in FIG. 6, the movable type cooled air discharging prevention means 50 is closed by the fixing plate 52 fixed on the upper shutter 41 by the screw 67 and by the insulating panel assembly 53 elastically upwardly supported by the elastic supporting means 58 at a predetermined position of the fixing housing 52, so that the food discharging opening 22*a* of the chute 22 is completely closed. In addition, in an installation of the movable type cooled air discharging prevention means 50, the fixing housing 52 is fitted into the upper shutter 41. The supporting body 60, the elastic member 62 and the washer 61 are engaged in order, respectively. The screw 59 is engaged into the fixing body 52. The insulating panel assembly 53 is placed onto the fixing housing 52. The fitness with the bottom portion of the chute 22 is adjusted. The sealing condition is achieved in the optimum state against the food discharging opening 22*a* of the chute by the insulating panel assembly 53 since the fixing housing 52 and the side wall of the lower housing of the insulating panel assembly 53 are engaged with screws 63.

In addition, the slidable movement of the insulating panel assembly 53 is well performed since the elastic plate 65 and the film 66 are attached to each other by the adhesive 64 in the lower plate 23 of the food freezing chamber 20. Thus, when the movable type cooled air discharging means 50 slidably moves, the upper housing 56 of the insulating panel assembly 53 becomes in contact with the film 66 attached on the lower housing 23. At this time, since the chemical treatment is made thereonto in order to reduce the friction force the friction force is minimized, so that the slidable movement of the movable type cooled air discharging prevention means 50 is well performed.

In addition, the sealing of the food discharging opening 22*a* of the chute 22 is more tightly performed since the elastic plate 65 is provided between the lower plate 23 and the film 66 thus concurrently performing the bumpering operation and the elastic adhesion operation during the slidable movement of the movable type cooled air discharging prevention means 50.

Figure 8:
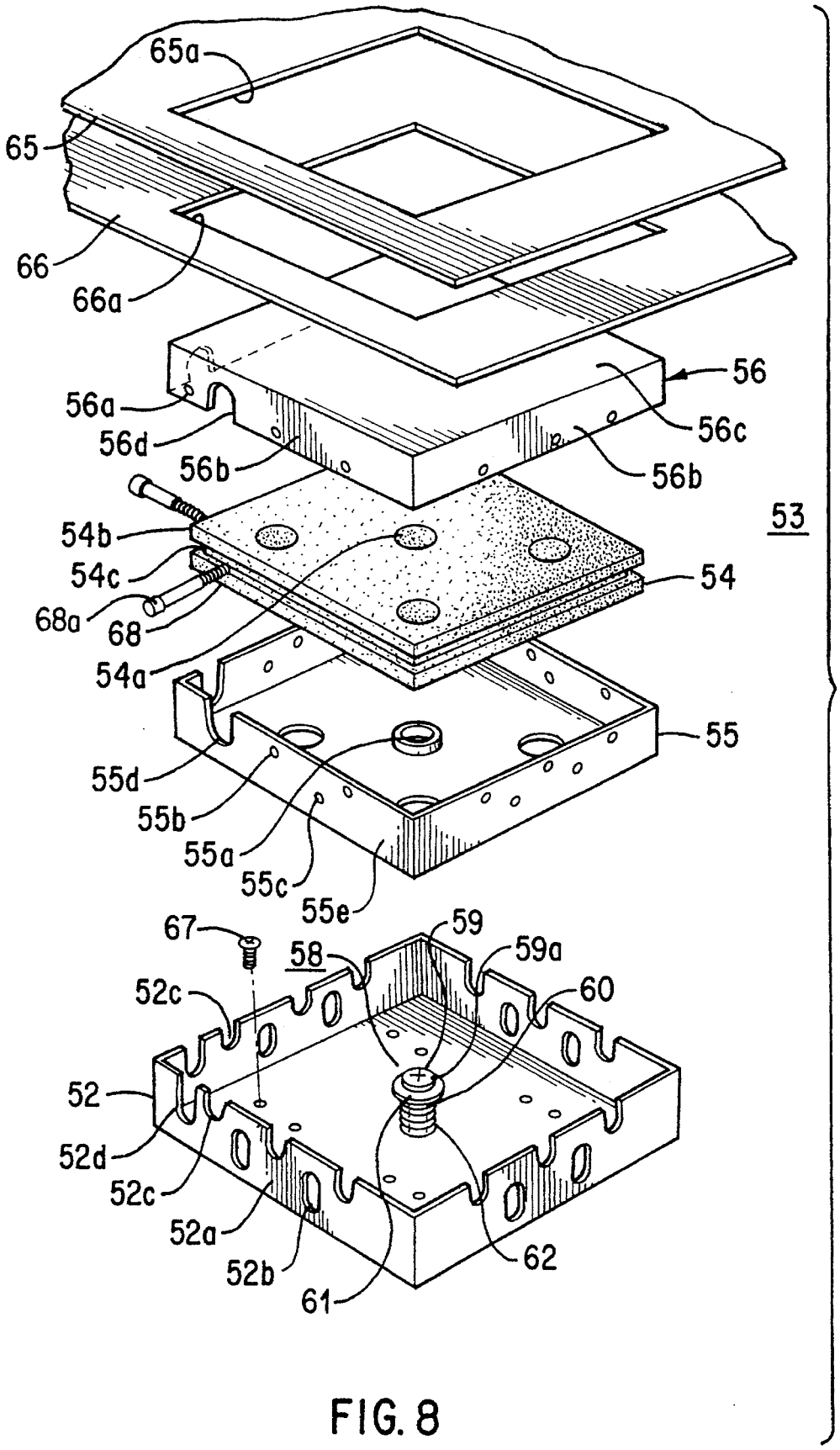
FIG. 8 is a perspective view showing a disassembled movable type cooled air discharging prevention means and stationary type guide supporting means of the other embodiment according to the present invention.
Figure 9:
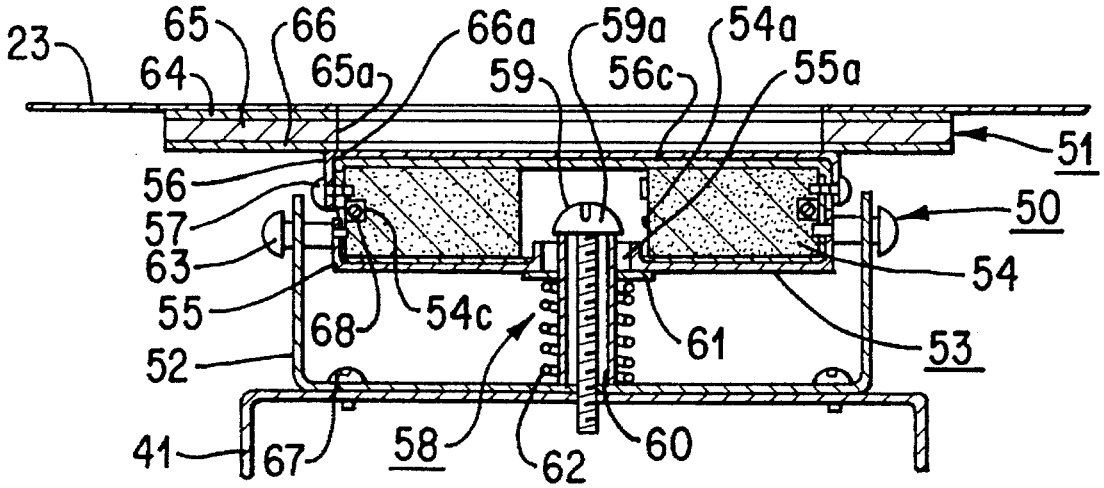
FIG. 9 is a cross sectional view showing a combination of the other embodiment according to the present invention.

Referring to FIGS. 8 and 9, there are shown the other embodiment, giving same reference numerals in case of the same with the first embodiment and being omitted in the detailed description.

The temperature of the vending machine according to the present invention are usually maintained between −18° C. and 20° C. There takes place dew on every wall 56*b* of the upper body 56 due to the temperature difference between the food freezing chamber 20 and the food heating chamber 30 since the food discharging opening 22*a* is in contact with the upper housing 56 of the insulating panel assembly 53.

Like this, if there takes place dew and the dew falls down inside the vending machine, the inside thereof becomes stained, so that the users feel upset due to the poor environment thereof. In addition, when the food freezing chamber 20 is over-freezed, the dew occurs much.

Accordingly, there are provided a groove 54C having a predetermined depth at each of side wall 54*b* of the insulating plate 54 and the heater 68 provided at the groove 54*c* for preventing the dew. In addition, there are provided a plurality of openings provided at side wall 56*b* and 55*e* of the upper housing 56 and the lower housing 55 for introducing the terminal of the heater 68 provided at the insulating plate 54. And, there are provided a plurality of holes 55*c* spaced apart by a predetermined distance at the bottom portion of the screw holes 55*b* provided at the side wall 55*e* of the lower housing 55. There are also provided openings 52*d* for introducing the terminal of the heater 68 outside even though at the insulating panel assembly 53 and the side wall 52*a* of the fixing housing 52, it is a different structure from the first embodiment according to the present invention.

The other structure of the fixing housing 52 is similar with the contents of the first embodiment according to the present invention and the detailed description thereof is omitted.

According to the other embodiment of the present invention, the heater 68 is inserted into the grooves 54*c* of the insulating plate 54. The temperature of the heater 68 is always maintained between 50° C. and 80° C. The temperature closer to the side wall 56*b* of the upper housing 56 near from the heater increase up to 30° C. thus removing moisture therearound, so that the dew generation is prevented on the side wall 56*b* of the upper housing 56. As the side wall 56*b* of the upper housing 56 being in contact with outside temperature of the food heating chamber 30 is always kept heated, the dew generation in the food freezing chamber 20 and the food heating chamber 30 is prevented. At this time, even though a part of the heat of the heater 68 is transferred to the upper plate 56*c* of the upper housing 56, it might be neglected since it is too small.

In conclusion, the cooled air is completely prevented from being discharged outside since in an initial state the food freezing chamber and the inside of the food heating chamber are closed by the insulating opening/closing assembly. In a process of heating the food in the food heating apparatus, there takes place heat. The heat is also completely prevented from being flowed to the food freezing chamber. In addition, to prevent the dew generating due to the temperature difference between the food freezing chamber and the food heating chamber, there are provided the heater in the side wall of the insulating plate.

What is claimed is:

1. A vending machine having a food storage box, a food freezing chamber having a chute for permitting the food from the food storage box to fall down, a food heating apparatus for heating the food fallen from the chute, and a food heating chamber having a food discharging port for discharging the heated food, comprising:

a movable type cooled air discharging prevention means, provided between a food discharging opening provided at a lower portion of the chute and an upper shutter provided at an upper portion of the food heating apparatus, for preventing cooled air from being discharged outside; and a stationary type supporting means, provided between a lower plate of the food freezing chamber and the movable type cooled air discharging prevention means, for permitting the movable type cooled air discharging prevention means to smoothly move and to absorb impacts thereon.

2. The vending machine of claim 1, wherein said movable type cooled air discharging prevention means includes a fixing housing engaged into an upper portion of the upper shutter by a plurality of screws, an insulating panel assembly fitted into an upper portion of the fixing housing, and an elastic supporting means provided at a bottom portion of the fixing housing for biasing the insulating panel assembly into sealing engagement with the food freezing chamber.

3. The vending machine of claim 2, wherein said fixing housing includes a plurality of elongated openings provided at one of upper and lower portions of each side wall, a plurality of semicircular openings spaced apart by a predetermined distance provided at an end portion of the side walls, the insulating panel assembly being able to be lifted along a long diameter of the elongated openings of the fixing housing.

4. The vending machine of claim 3, wherein said fixing housing includes at least more than one groove provided at one end of an upper portion of the side walls of the fixing housing having a length longer than that of the semicircular openings.

5. The vending machine of claim 2, wherein said insulating panel assembly includes a longitudinally-shaped insulating plate having a plurality of screw openings, a lower housing having a plurality of screw holes at a bottom portion thereof for fitting the insulating plate, and an upper housing for fitting the lower housing.

6. The vending machine of claim 5, wherein said upper housing includes a plurality of side walls and a plurality of screw holes at each of said side walls, said lower housing includes side walls having a plurality of openings positionally corresponding with the screw holes of the upper housing when the lower housing is engaged with the upper housing and screw through holes provided at a lower portion of the lower housing.

7. The vending machine of claim 2, wherein said insulating panel assembly includes: an insulating plate comprising a plurality of side walls, a groove with a predetermined depth being provided at each of said side walls, and a heater provided at the grooves for preventing moisture; a lower housing with a shape of a box and an upper portion opening for fixing said insulating plate; and an upper housing having a bottom portion opened for fitting the lower housing.

8. The vending machine of claim 7, wherein both said insulating plate and said lower housing have a plurality of screw holes and screw openings.

9. The vending machine of claim 7, wherein said upper housing includes a plurality of side walls and a plurality of screw holes provided at each said side wall, at least more than one semicircular opening provided to accommodate a terminal of the heater; a plurality of screw holes spaced apart by a predetermined distance and provided at each of a plurality of side walls of the lower housing, at least more than one semicircular opening in the lower housing, and a plurality of other screw holes spaced apart by a predetermined distance and provided at a portion of the lower housing that is lower than the screw holes of the lower housing.

10. The vending machine of claim 2, wherein said elastic supporting means includes: an elastic member in contact with a bottom portion of the fixing housing, a washer provided at an upper portion of the elastic member, a supporting body passing through the elastic member and the washer, and screws for engaging the supporting body.

11. The vending machine of claim 10, wherein said elastic member comprises a compression coil spring.

12. The vending machine of claim 1, wherein said stationary type supporting means includes an elastic plate fixed to a lower portion of the food freezing chamber by an adhesive, and a film attached to the lower portion of the stationary type supporting means to allow smooth sliding between an insulting panel assembly and an upper housing.

13. The vending machine of claim 12, wherein said elastic plate and said film include a tetragonal opening equal in size to the food discharging opening provided at a lower portion of the chute.

14. The vending machine of claim 12, wherein said film is made of polyester.

15. The vending machine of claim 1, wherein said movable type cooled air discharging prevention means includes a biasing member.

16. The vending machine of claim 1, wherein said movable type cooled air discharging prevention means includes an insulating member positioned proximate to a fixing housing.

17. The vending machine of claim 1, wherein said movable type cooled air discharging prevention means is removably attached to said shutter.

18. The vending machine of claim 1, wherein said movable type cooled air discharging prevention means is positioned between an uppermost portion of said shutter and the lower portion of the chute.

19. The vending machine of claim 1, wherein said stationary type supporting means includes an elastic portion.

20. The vending machine of claim 1, wherein said stationary type supporting means includes a film.

21. A vending machine having a food storage section, a food freezing chamber having a chute for permitting the food from the food storage section to fall down, a food heater so located as to heat food fallen from the chute, and a food heating chamber having a heated food discharging port, comprising:

a movable member provided between a food discharging opening provided at a lower portion of the chute and a shutter provided at an upper portion of the food heater, said movable member being in selective engagement with said food discharging opening, said movable member being movable in first and second directions, wherein said first and second directions are not parallel.

* * * * *